US011703270B2

(12) United States Patent
Estève

(10) Patent No.: US 11,703,270 B2
(45) Date of Patent: Jul. 18, 2023

(54) WINE COOLER WITH REVERSIBLE DOOR

(71) Applicant: Electrolux Appliances Aktiebolag, Stockholm (SE)

(72) Inventor: Jérôme Estève, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 201 days.

(21) Appl. No.: 17/312,632

(22) PCT Filed: Dec. 21, 2018

(86) PCT No.: PCT/EP2018/086497
§ 371 (c)(1),
(2) Date: Jun. 10, 2021

(87) PCT Pub. No.: WO2020/126024
PCT Pub. Date: Jun. 25, 2020

(65) Prior Publication Data

US 2022/0074643 A1 Mar. 10, 2022

(51) Int. Cl.
*F25D 23/02* (2006.01)

(52) U.S. Cl.
CPC ..... *F25D 23/028* (2013.01); *F25D 2323/022* (2013.01)

(58) Field of Classification Search
CPC ..... F25D 23/028; F25D 2323/022; Y10T 16/553; Y10T 16/5535; E05D 5/128
See application file for complete search history.

(56) References Cited

U.S. PATENT DOCUMENTS 4,503,584 A * 3/1985 Malchow ..... E05D 15/505 16/DIG. 23
4,620,392 A * 11/1986 Kerpers ..... F25D 23/028 16/229

(Continued)

FOREIGN PATENT DOCUMENTS

CA 2573323 A1 * 9/2007 ..... F25D 23/126
CN 108590404 A * 9/2018 ..... E05D 7/02

(Continued)

OTHER PUBLICATIONS

International Search Report for PCT/EP2018/086497 dated Sep. 13, 2019, 2 pages.

*Primary Examiner* — Hanh V Tran
(74) *Attorney, Agent, or Firm* — Pearne & Gordon LLP

(57) ABSTRACT

The present disclosure relates to a household appliance (20) comprising a reversible front door (22) configured to be selectably attached either on a left side or a right side of a cabinet (21) of the household appliance (20). The household appliance (20) further comprises a profile (23) configured to act as a handle being arranged on a top side of the front door (22), a detachable hinge (27) arranged to be mounted to the cabinet (21) behind the front door (22) and further being configured to extend into a cavity (21) of the front door (22) arranged below the profile (23) to connect the front door (22) to the cabinet (21), and a locking pin (29), wherein the profile (23) comprises a through hole (28) at at least one of its two ends for receiving the locking pin (29) configured to be inserted into the through hole (28) from an upper side of the profile (23), which locking pin (29) engages with a cavity (30) of the hinge (27) arranged under the profile (23) to pivotably attach the front door (22) to the hinge (27).

11 Claims, 5 Drawing Sheets

(56) References Cited

U.S. PATENT DOCUMENTS 4,671,582 A * 6/1987 Stromquist ..... E05D 11/0081 439/31
5,975,663 A * 11/1999 Becker ..... A47B 96/00 16/374
6,000,771 A * 12/1999 Wissinger ..... F25D 23/02 312/401
10,427,149 B2 * 10/2019 Efinger ..... E05C 7/02
10,697,695 B1 * 6/2020 Bradley ..... F25D 23/04
11,124,998 B1 * 9/2021 Fazi ..... E05D 7/081
2003/0151339 A1 * 8/2003 Reed ..... E05D 7/081 312/405
2006/0017361 A1 * 1/2006 Rendel ..... E05D 11/0081 312/405
2007/0256447 A1 * 11/2007 Leimkuehler ..... F25D 23/028 62/440
2008/0034539 A1 * 2/2008 Lyvers ..... E05D 7/0423 16/238
2008/0295291 A1 * 12/2008 Lee ..... F25D 23/028 16/412
2010/0101267 A1 * 4/2010 Jung ..... F25D 23/028 62/449
2011/0241512 A1 10/2011 Jung et al.
2012/0037644 A1 * 2/2012 Lee ..... F25D 23/028 220/592.02
2016/0209110 A1 * 7/2016 Cho ..... F25D 23/062
2017/0205134 A1 * 7/2017 Osbar ..... F25D 11/00
2018/0318823 A1 * 11/2018 Baumgaertner .... E05B 65/0042
2019/0145140 A1 * 5/2019 Zhang ..... F25D 23/028 49/382
2019/0145695 A1 * 5/2019 Xia ..... E05D 15/50 312/405
2019/0170429 A1 * 6/2019 Kim ..... F25D 23/028
2020/0025437 A1 * 1/2020 Park ..... F25D 23/02

FOREIGN PATENT DOCUMENTS

DE 102014217664 3/2016
EP 2182311 5/2010
EP 2743435 A1 * 6/2014 ..... F25D 23/028
EP 3276288 A1 * 1/2018 ..... E05D 11/0054
JP S6087984 U * 6/1985
KR 19990056273 A * 7/1999
KR 20070113869 A * 11/2007
WO WO-0246560 A1 * 6/2002 ..... E05D 15/505
WO WO-2004074617 A1 * 9/2004 ..... E05D 15/505
WO WO-2010029094 A2 * 3/2010 ..... F25D 23/028
WO WO-2014194954 A1 * 12/2014 ..... F25D 23/028
WO WO-2015078314 A1 * 6/2015 ..... E05D 15/505
WO WO-2017206502 A1 * 12/2017 ..... E05D 15/505

* cited by examiner

WINE COOLER WITH REVERSIBLE DOOR

TECHNICAL FIELD

The present disclosure relates to a household appliance comprising a reversible front door configured to be selectably attached either on a left side or a right side of a cabinet of the household appliance.

BACKGROUND

Refrigerators in the form of wine coolers are becoming increasingly popular.

FIG. 1 shows a front perspective view of a prior art wine cooler 10.

The wine cooler 10 comprises a cabinet 11 in which bottles are stored. Further, the wine cooler 10 comprises a front door 12 for opening and closing the wine cooler 10. The door 12 comprises a handle 13 via which a user can open/close the door 12.

The handle 13 slightly protrudes from the door 12, which is less appealing for aesthetic reasons and further makes the front door 12 more difficult to clean.

SUMMARY

One objective is to solve, or at least mitigate, this problem in the art and to provide an improved household appliance, such as a wine cooler.

This object is attained by a household appliance comprising a reversible front door configured to be selectably attached either on a left side or a right side of a cabinet of the household appliance. The household appliance further comprises a profile configured to act as a handle being arranged on a top side of the front door, a detachable hinge arranged to be mounted to the cabinet behind the front door and further being configured to extend into a cavity of the front door arranged below the profile to connect the front door to the cabinet, and a locking pin. Further, the profile comprises a through hole at at least one of its two ends for receiving the locking pin configured to be inserted into the through hole from an upper side of the profile, which locking pin engages with a cavity of the hinge arranged under the profile to pivotably attach the front door to the hinge.

Advantageously, the household appliance being for instance a wine cooler comprises a profile configured to act as a handle being arranged on a top side of the front door, thereby being flush with the front door. Hence, any parts protruding from the front door is advantageously avoided.

Further advantageous, by configuring the profile with a through hole at one of its ends (or with a respective through hole at each end) for receiving a locking pin configured to be inserted into the through hole from an upper side of the profile to engage with a cavity of the hinge arranged under the profile to pivotably attach the door to the hinge, swift removal of the door from the hinge is enabled without any specialized tools, if a rehanging of the door on the opposite side of the cabinet is required (even though a tool such as a screw driver typically would be required to unfasten the hinge(s) from the cabinet and fasten the hinge(s) on the opposite side).

In an embodiment, the profile comprises a first through hole at one of its two ends for receiving the locking pin configured to be inserted into the first through hole from an upper side of the profile, which locking pin engages with the cavity of the hinge arranged under the profile to pivotably attach the front door to the hinge, and the profile further comprises a second through hole at another one of its two ends for receiving the locking pin configured to be inserted into the second through hole from an upper side of the profile, which locking pin engages with a cavity of a hinge being mounted to an opposite side of the cabinet and arranged under the profile to pivotably attach the front door to the hinge being mounted to the opposite side of the cabinet upon the front door being reversed.

In an embodiment, the profile is configured to extend over a gasket arranged at a top section of the front door to cover the gasket from being visible.

In an embodiment, the profile is configured to extend over a top section of the hinge in order to cover the hinge from being visible.

In an embodiment, the detachable hinge is L-shaped with one member being arranged to be mounted to the cabinet while the other comprises the cavity to be engaged with the locking pin.

In an embodiment, a locking pin maintaining element is configured to be set in locking engagement with the locking pin for maintaining the locking pin in engagement with the cavity of the hinge.

In an embodiment, the front door comprises a socket in which the locking pin maintaining element is arranged to be inserted in a direction perpendicular to a longitudinal axis of the locking pin for locking engagement with the locking pin.

In an embodiment, the locking pin comprises at least one recess configured to mate with a corresponding locking member of the locking pin maintaining element upon the locking pin maintaining element being inserted in the socket.

In an embodiment, the locking pin comprises a first and a second recess configured to mate with a corresponding first and second locking member of the locking pin maintaining element.

Generally, all terms used in the claims are to be interpreted according to their ordinary meaning in the technical field, unless explicitly defined otherwise herein. All references to "a/an/the element, apparatus, component, means, etc." are to be interpreted openly as referring to at least one instance of the element, apparatus, component, means, etc., unless explicitly stated otherwise.

BRIEF DESCRIPTION OF THE DRAWINGS

Aspects and embodiments are now described, by way of example, with reference to the accompanying drawings, in which.

DETAILED DESCRIPTION

The aspects of the present disclosure will now be described more fully hereinafter with reference to the accompanying drawings, in which certain embodiments of the invention are shown.

These aspects may, however, be embodied in many different forms and should not be construed as limiting; rather, these embodiments are provided by way of example so that this disclosure will be thorough and complete, and to fully convey the scope of all aspects of invention to those skilled in the art. Like numbers refer to like elements throughout the description.

Figure 1:
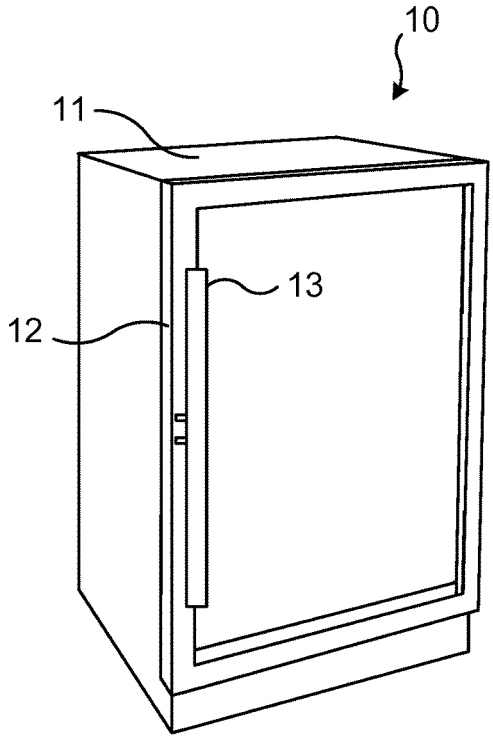
FIG. 1 shows a front perspective view of a prior art household appliance configured to store food items.

FIG. 1 shows a front perspective view of a prior art household appliance 10 configured to store food items, such as a small refrigerator or a wine cooler. The household appliance 10 will in the following be referred to as a fridge.

Now, the fridge 10 comprises a cabinet 11 in which the food items, such as for instance fruit and vegetables, canned goods, milk cartons, meat, cheese, bottles, etc., are stored. Further, the fridge 10 comprises a front door 12 for opening and closing the fridge 10. In the case of a wine cooler, a main part of the door 12 is typically made of clear or slightly tinted glass enclosed by a section of darkly tinted glass. Further, the door 12 comprises a handle 13 via which a user can open/close the door 12.

The handle 13 slightly protrudes from the door 12, which is less appealing for aesthetic reasons and further makes the front door 12 more difficult to clean.

Figure 2:
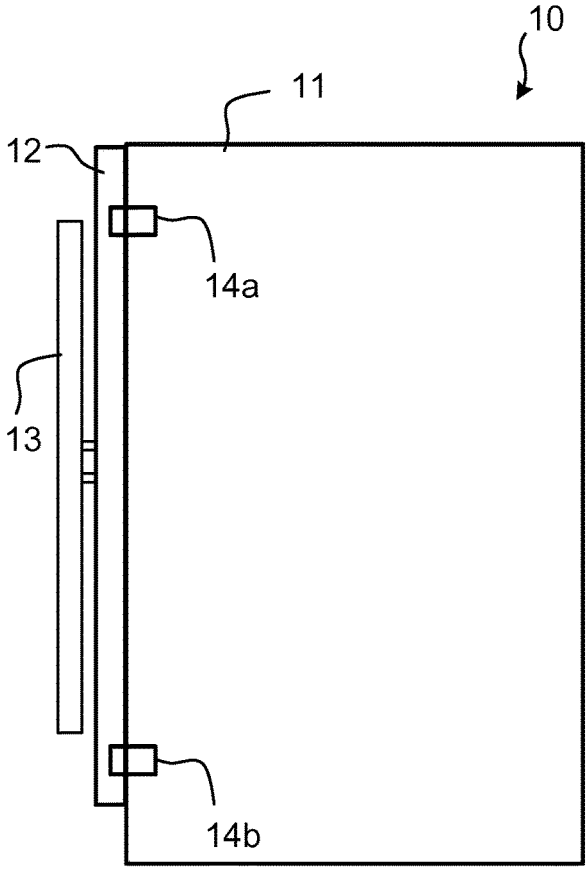
FIG. 2 shows a side view of a prior art household appliance configured to store food items.

FIG. 2 shows a side view of a prior art fridge 10. As can be seen, the fridge 10 comprises the cabinet 11, the front door 12 and the handle 13 of FIG. 1, and in this example also an upper and a lower hinge 14*a*, 14*b* for connecting the front door to the cabinet 13.

Again, visible hinges 14*a*, 14*b* are less appealing for aesthetic reasons. Further, in case a manufacturer of the fridge 10 wishes to provide a reversible door 12, i.e. a door 12 which can be re-hung and thus opened in a left-hand direction instead of a right hand direction as illustrated in FIG. 1, holes for accommodating screws or some other appropriate fastening means to fasten the hinges 14*a*, 14*b*—and thus connecting the door 12—to the cabinet 13 are required on both a right-hand side and a left-hand side of an exterior of the cabinet 13. Typically, each hinge 14*a*, 14*b* is fastened to the cabinet 13 with two screws.

This will further require covering plugs or the like to be is inserted into the four holes arranged on the side of the cabinet 13 where the door 12 currently not is mounted. Again, such covering plugs are less appealing for aesthetic reasons and further are easily lost.

Figure 3:
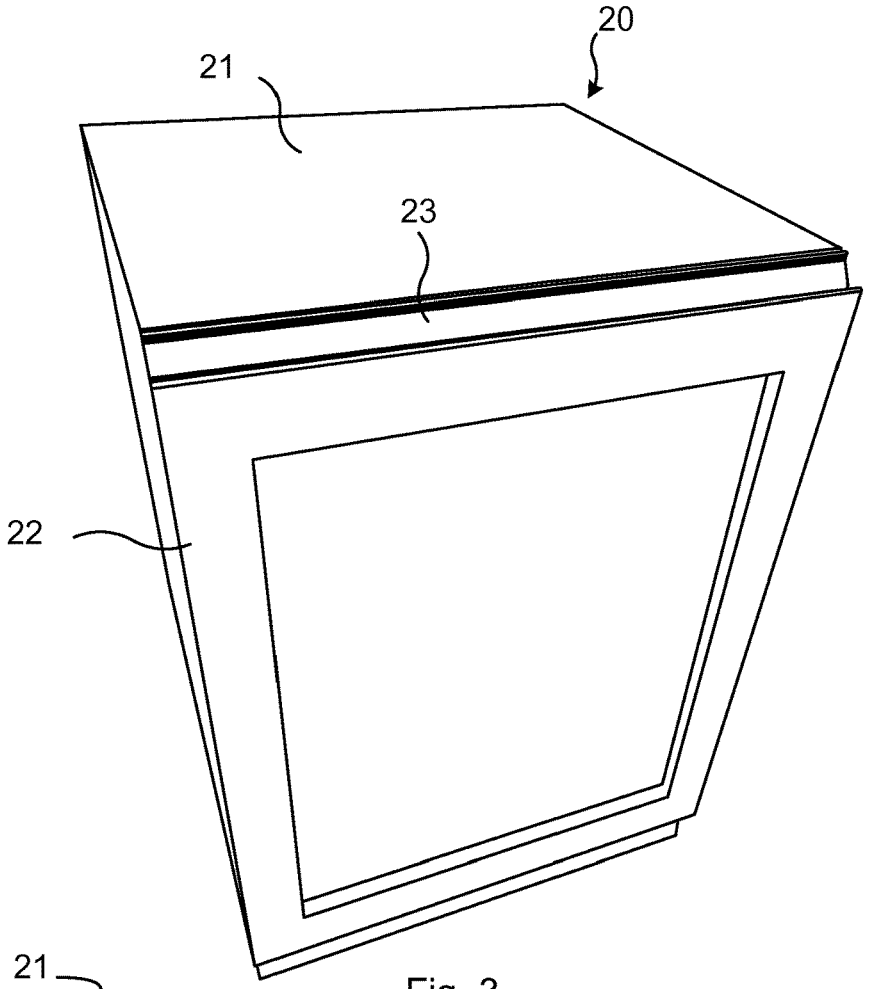
FIG. 3 shows a front perspective view of a household appliance configured to store food items according to an embodiment.

FIG. 3 shows a front perspective view of a household appliance 20 configured to store food items according to an embodiment, such as small a refrigerator or a wine cooler. The household appliance 20 will in the following be referred to as a fridge.

As is shown in FIG. 3, the fridge 20 according to this embodiment comprises a profile 23 configured to act as a handle being arranged on a top side of the front door 22, which profile 23 further is configured to be flush with the front door 22. Thereby, in contrast to the prior art fridge 10 of FIGS. 1 and 2, any parts protruding from the front door 22 is advantageously avoided.

Figure 4:
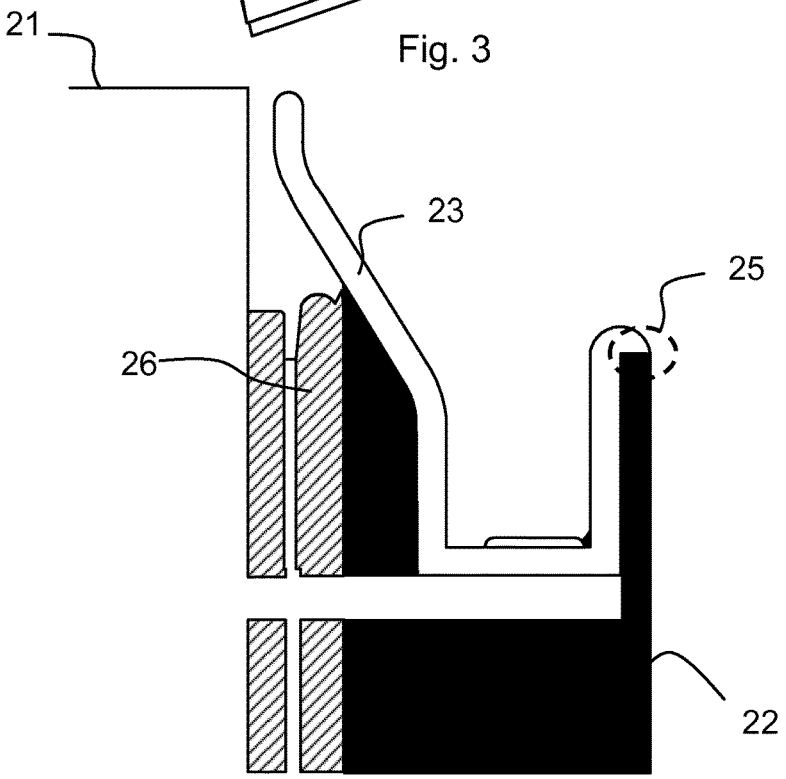
FIG. 4 shows a top section of the household appliance according to an embodiment in a cross-sectional left-hand side view.

FIG. 4 shows a top section of the fridge 20 according to an embodiment in a cross-sectional left-hand side view. As can be seen, the profile 23 acting as handle for a user to open the door 22 of the fridge 20 is arranged on a top side of the front door 22, and a section 25 of the profile 23 facing the front side of the door 22 is configured to be flush with—or at least to be configured to not protrude from a front of—the front door 22 to advantageously avoid any elements of the fridge 20 protruding from the front of the door 22.

A gasket 26 is further attached to an interior of the front door 22 to ensure that the door fits tight with the cabinet 21, i.e. the gasket 26 fits with a ceiling, a floor, and two side walls enclosing an interior of the cabinet 21. Further in an embodiment, the profile 23 is configured to extend over—and cover—the gasket 26, and possibly even over a top section of the cabinet 21.

Figure 5:
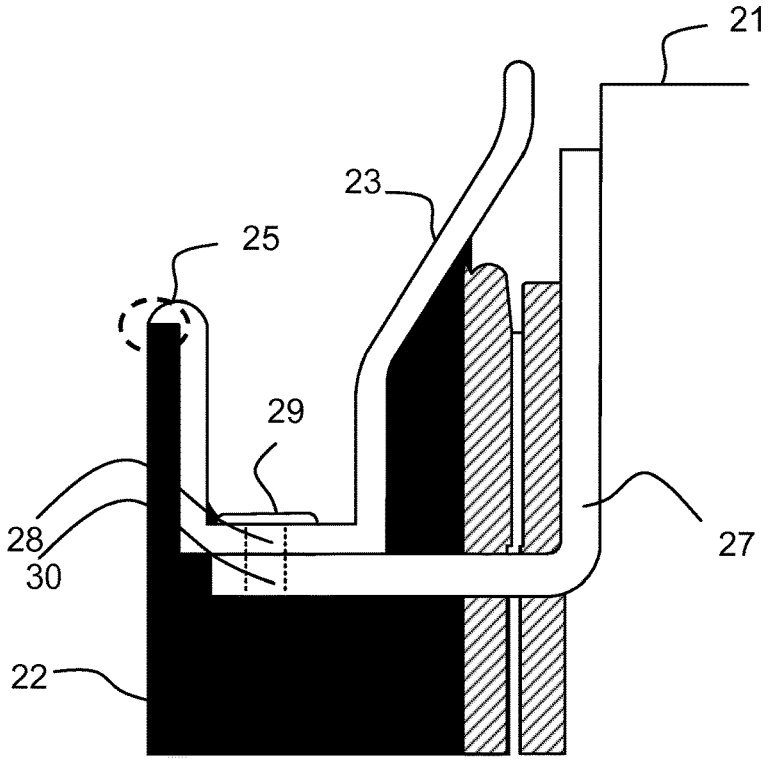
FIG. 5 shows the top section of the household appliance illustrated in FIG. 4, but in a cross-sectional right-hand side view.

FIG. 5 shows the top section of the fridge 20 illustrated in FIG. 4, but in a cross-sectional right-hand side view.

Figure 6:
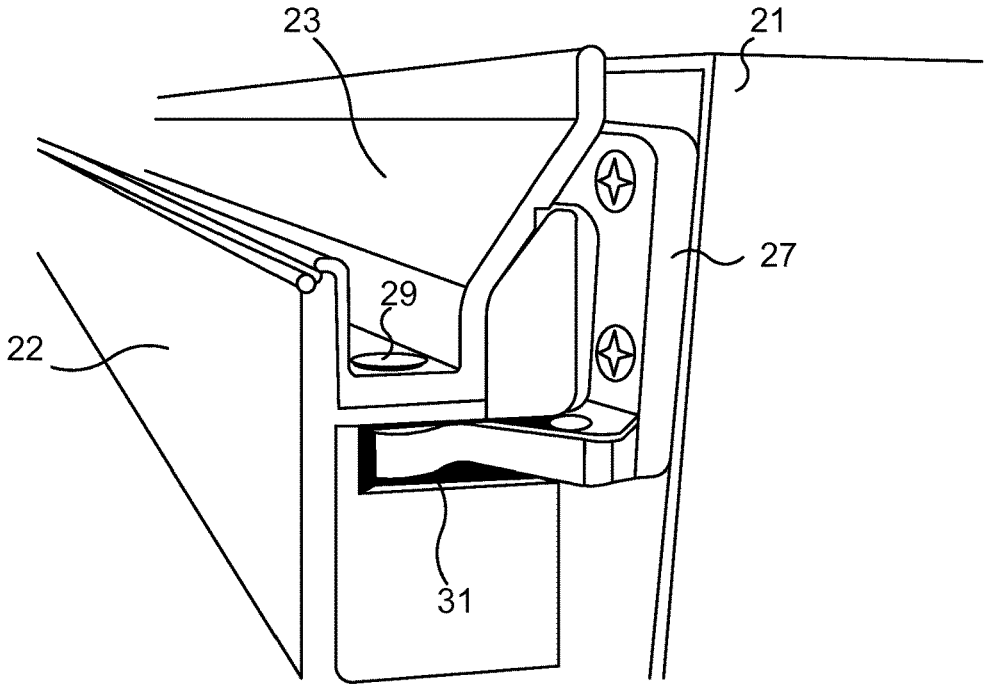
FIG. 6 shows a top section of a household appliance according to an embodiment in a perspective right-hand side view.

Reference will further be made to FIG. 6 showing a top section of the fridge 20 according to an embodiment in a perspective right-hand side view.

As can be seen, a hidden, detachable (upper) hinge 27 is mounted to the cabinet 21 behind the door 22 and is configured to extend below the profile 23 to connect the door 22 to the cabinet 21. In this particular exemplifying embodiment, the hinge 27 is L-shaped, even though any other appropriate shape can be envisaged.

Advantageously, with the profile 23 extending over the top section of the cabinet 21, or at least over an upper section of the hinge 27, hiding of the detachable hinge 27 will be even further facilitated.

The profile 23 is configured with a through hole 28 at at least one of its two ends for receiving a locking pin 29 configured to be inserted into the though hole 28 from an upper side of the profile 23, which pin 29 engages with a cavity 30 of the hinge 27 arranged under the profile 23 in a cavity 31 of the door 22 to pivotably attach the door 22 to the hinge 27. As can be seen, in this exemplifying embodiment, the cavity 30 is embodied by means of a through-hole. However, any appropriate hollow member into which the pin 29 can be inserted may be envisaged, such as a cylindric cup-like cavity.

In the embodiments illustrated with reference to FIGS. 3-6, the profile 23 is not symmetric along its longitudinally extending axis and will thus be configured with a first through hole 28 at one of its ends and a second through hole (not shown) at the other end to enable the door 22 to be reversible.

Upon reversing the door 22, i.e. attaching the door to a (mirrored) hinge mounted on a left-hand side of the cabinet such that the door is opened in left-hand direction instead of in a right-hand direction, the locking pin 29 is removed by the user from the right-hand side through hole 28 and out of engagement with the cavity 30 of the right-hand hinge 27, whereby the user can remove the door 22 and attach a similar but mirrored hinge to the left-hand side of the cabinet for facilitating reversal of the door.

It is noted that a lower hinge (not shown, cf. FIG. 2) attached to a lower section of the cabinet 21 closer to floor further typically will be used for attaching the door 22 to the cabinet 21 at two contact points, i.e. at a lower and an upper hinge. Any available appropriate hideable hinge may be used as a lower hinge. Hence, the lower hinge should be configured such that is hidden behind the front door upon being mounted to the cabinet of the fridge.

In analogy with the procedure described hereinabove, when reversing the door, the user attaches the hinge(s) to the left-hand side, fits the door with the (upper) hinge via a cavity of the door on the left-hand side of the door, inserts a locking pin in the left-hand through hole arranged at the opposite end of the profile thereby engaging the locking pin with the cavity of the hinge being mounted at the left-hand side of the cabinet to pivotably attach the door to the hinge at the left-hand side of the door.

Figure 7:
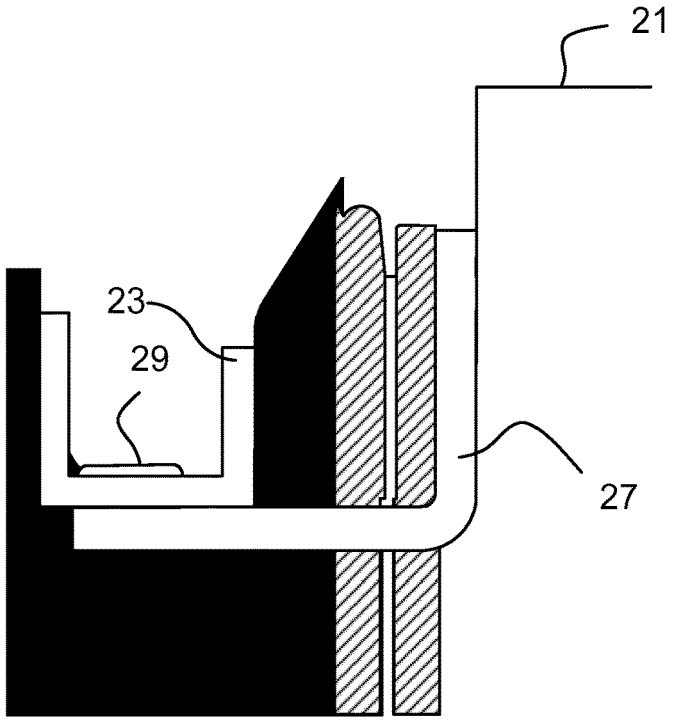
FIG. 7 shows a top section of the household appliance according to another embodiment illustrated in a cross-sectional right-hand side view.
Figure 8:
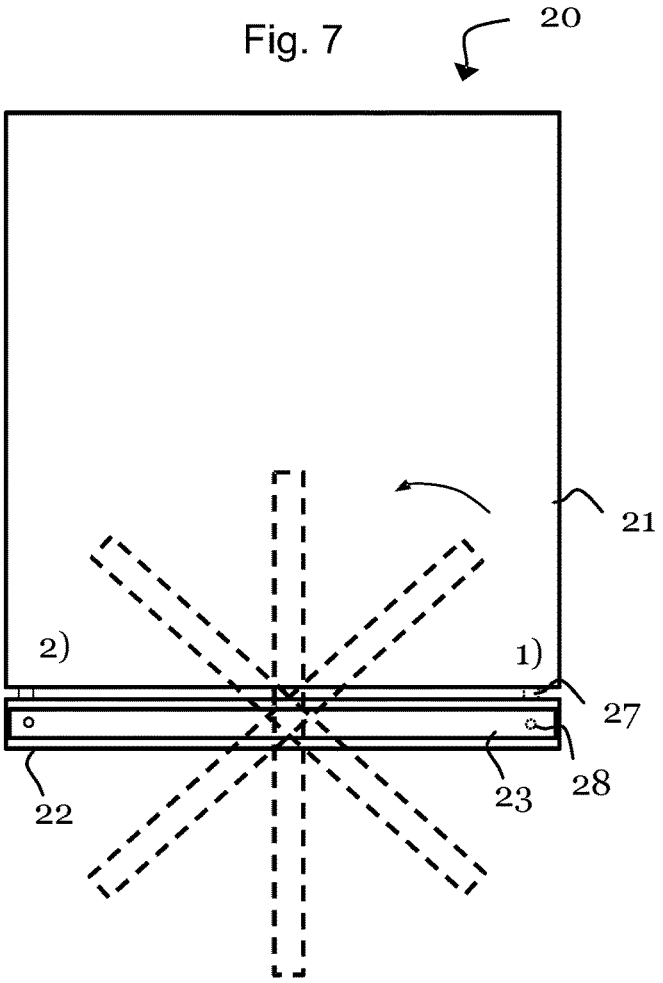
FIG. 8 illustrates the household appliance according to an embodiment illustrated in a top view.

With reference to FIG. 7 (showing a similar view as that of FIG. 5) and FIG. 8 illustrating the fridge 20 in a top view, in case of the profile 23 being symmetrical along its longitudinally extending axis, only a single through hole 28 would be necessary, since the profile 23 could be loosened from the top section of the door 22 where it is arranged and rotated 180 degrees when the door 22 is to be reversed, as shown in FIG. 8.

Hence, in first position 1), where the door 22 is opened in a right-hand direction, the locking pin 29 is removed from engagement with the hinge 27 such that the hinge 27 can be detached from the right side of the cabinet 21 and mounted to the left side. The profile 23 is removed from the top side of the door 22 and rotated 180° horizontally to second position 2) and again placed on the top side of the door 22 such that the through hole 28 is positioned at the left-hand side of the door 22 and the locking pin 29 can be inserted in the through hole 28 for engagement with the hinge 27 now having been attached to the left-hand side of the cabinet 21.

As further can be seen in FIG. 7, in case of a symmetrical profile 23, it may be necessary to either shorten a member of the hinge 27 being attached to the cabinet 21 or place the hinge 27 in a position slightly further down the cabinet 21 to properly hide the hinge 27.

Advantageously, by configuring the profile 23 with a through hole 28 at one of its ends (or with a respective through hole at each end) for receiving a locking pin 29 configured to be inserted into the through hole 29 from an upper side of the profile 23 to engage with a cavity 30 of the hinge arranged under the profile to pivotably attach the door 22 to the hinge 27, swift removal of the door 22 from the hinge 27 is enabled without any specialized tools, if a rehanging of the door 22 on the opposite side of the cabinet 21 is required (even though a tool such as a screw driver typically would be required to unfasten the hinge(s) from the cabinet and fasten the hinge(s) on the opposite side).

Figure 9A:
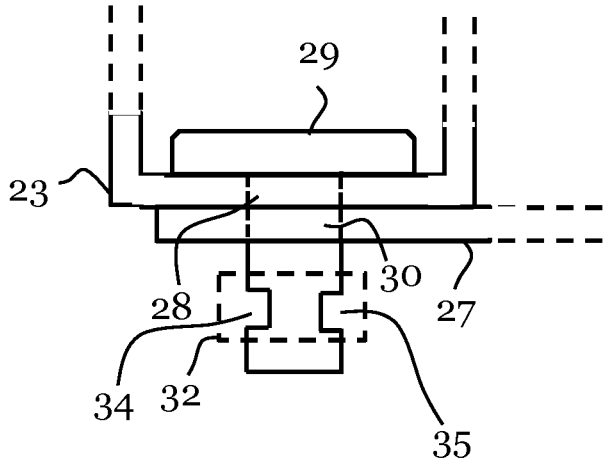
FIGS. 9*a-c* illustrate locking pin engagement according to an embodiment.
Figure 9B:
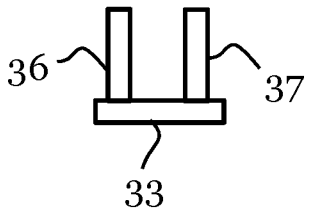
Figure 9C:
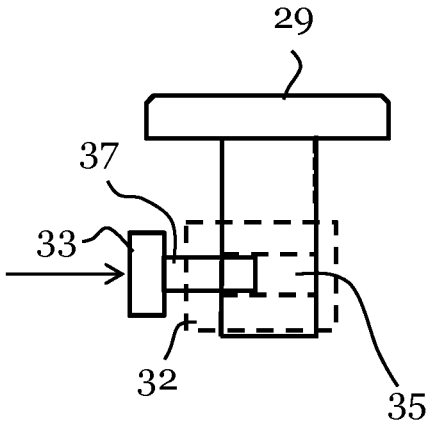

In a further embodiment, with reference to FIG. 9*a* showing the locking pin 29 in a cross-sectional view taken along a short side of the profile 23, and to FIG. 9*b* showing a locking pin maintaining element 33 in a top view As is shown in FIG. 9*c* showing the locking pin 29 in a cross-sectional view taken along a length of the profile 23, the locking pin maintaining element 33 is introduced to facilitate maintaining the locking pin 29 in engagement with the cavity 30 of the hinge 27. Hence, the locking pin maintaining element 33 is configured to be set in locking engagement with the locking pin 29.

As is shown in FIG. 9*a*, the locking pin 29 is inserted into the through hole 28 from an upper side of the profile 23, wherein the locking pin 29 engages with the cavity 30 of the hinge 27 arranged under the profile 23 to pivotably attach the door to the hinge 27.

A socket 32 is arranged in the door to accommodate the locking pin maintaining element 33. Thus, as shown in FIG. 9*c*, the locking pin maintaining element 33 is inserted into the socket 32 from a side of the door in a direction perpendicular to (the direction being indicated by the arrow) a longitudinal axis of the locking pin 29 and engages with the locking pin 29 to maintain the locking pin in the cavity 30 of the hinge 27.

If a user is to remove the locking pin 29 in order to reverse the door, the locking pin maintaining element 33 should first be removed from the socket 32 thereby removing the locking pin maintaining element 33 from locking engagement with the locking pin 29. Thereafter, the locking pin 29 can be removed by the user.

In an embodiment, the locking pin 29 comprises at least one recess configured to mate with a corresponding locking member of the locking pin maintaining element 33.

As shown in FIGS. 9*a-c*, in an embodiment, the locking pin 29 comprises a first and a second recess 34, 35 configured to mate with a corresponding first and second locking member 36, 37 of the locking pin maintaining element 33.

The aspects of the present disclosure have mainly been described above with reference to a few embodiments and examples thereof. However, as is readily appreciated by a person skilled in the art, other embodiments than the ones disclosed above are equally possible within the scope of the invention, as defined by the appended patent claims.

The invention claimed is:

1. A household appliance (20) comprising a reversible front door (22) configured to be selectably attached either on a left side or a right side of a cabinet (21) of the household appliance (20), the household appliance (20) further comprising:

a profile (23) configured to act as a handle being arranged on a top side of the front door (22);

a detachable hinge (27) arranged to be mounted to the cabinet (21) behind the front door (22) and further being configured to extend into a cavity (21) of the front door (22) arranged below the profile (23) to connect the front door (22) to the cabinet (21); and a locking pin (29); wherein the profile (23) comprises a through hole (28) at at least one of its two ends for receiving the locking pin (29) configured to be inserted into the through hole (28) from an upper side of the profile (23), which locking pin (29) engages with a cavity (30) of the hinge (27) arranged under the profile (23) to pivotably attach the front door (22) to the hinge (27).

2. The household appliance (20) of claim 1, wherein:

the profile (23) comprises a first through hole (28) at one of its two ends for receiving the locking pin (29) configured to be inserted into the first through hole (28) from an upper side of the profile (23), which locking pin (29) engages with the cavity (30) of the hinge (27) arranged under the profile (23) to pivotably attach the front door (22) to the hinge (27); and the profile further comprises a second through hole at another one of its two ends for receiving the locking pin (29) configured to be inserted into the second through hole from an upper side of the profile (23), which locking pin (29) engages with a cavity of a hinge being mounted to an opposite side of the cabinet (21) and arranged under the profile (23) to pivotably attach the front door (22) to the hinge being mounted to the opposite side of the cabinet (21) upon the front door (22) being reversed.

3. The household appliance (29) of claim 1, the profile (23) further being configured to be flush with a front side of the front door (22).

4. The household appliance (20) of claim 1, wherein:

the profile (23) is configured to extend over a gasket (26) arranged at a top section of the front door (22) to cover the gasket (26) from being visible.

5. The household appliance (20) of claim 1, wherein:

the profile (23) is configured to extend over a top section of the hinge (27) in order to cover the hinge (27) from being visible.

6. The household appliance (20) of claim 1, wherein:

the detachable hinge (27) is L-shaped with one member being arranged to be mounted to the cabinet (21) while the other comprises the cavity (30) to be engaged with the locking pin (29).

7. The household appliance (20) of claim 1, further comprising:

a locking pin maintaining element (33) configured to be set in locking engagement with the locking pin (29) for maintaining the locking pin (29) in engagement with the cavity (30) of the hinge (27).

8. The household appliance (20) of claim 7, wherein:

the front door (22) comprises a socket (32) in which the locking pin maintaining element (33) is arranged to be inserted in a direction perpendicular to a longitudinal axis of the locking pin (29) for locking engagement with the locking pin (29).

9. The household appliance (20) of claim 8, wherein:

the locking pin (29) comprises at least one recess (34, 35) configured to mate with a corresponding locking member (36, 37) of the locking pin maintaining element (33) upon the locking pin maintaining element (33) being inserted in the socket (32).

10. The household appliance (20) of claim 9, wherein:

the locking pin (29) comprises a first and a second recess (34, 35) configured to mate with a corresponding first and second locking member (36, 37) of the locking pin maintaining element (33).

11. The household appliance (20) of claim 1, the appliance (20) being a refrigerator or a wine cooler.

* * * * *